US011241695B2

(12) United States Patent
Troiano

(10) Patent No.: US 11,241,695 B2
(45) Date of Patent: Feb. 8, 2022

(54) METHOD AND SYSTEM FOR RECYCLING POLYSTYRENE WASTE

(71) Applicant: Louis James Troiano, Milford, PA (US)

(72) Inventor: Louis James Troiano, Milford, PA (US)

( * ) Notice: Subject to any disclaimer, the term of this patent is extended or adjusted under 35 U.S.C. 154(b) by 863 days.

(21) Appl. No.: 15/723,736

(22) Filed: Oct. 3, 2017

(65) Prior Publication Data

US 2018/0099290 A1 Apr. 12, 2018

Related U.S. Application Data

(60) Provisional application No. 62/406,335, filed on Oct. 10, 2016.

(51) Int. Cl.

| | |
|---|---|
| ***B02C 21/02*** | (2006.01) |
| ***B02C 18/00*** | (2006.01) |
| ***B65D 90/00*** | (2006.01) |
| ***B65D 88/74*** | (2006.01) |
| ***B65D 88/12*** | (2006.01) |

(52) U.S. Cl.

CPC ..... *B02C 21/02* (2013.01); *B02C 18/0084* (2013.01); *B65D 88/121* (2013.01); *B65D 88/74* (2013.01); *B65D 90/0086* (2013.01); *B02C 2201/06* (2013.01); *B65D 88/127* (2013.01)

(58) Field of Classification Search

None

See application file for complete search history.

(56) References Cited

U.S. PATENT DOCUMENTS

| | | | | |
|---|---|---|---|---|
| 3,727,785 | A * | 4/1973 | Lutz | B65D 9/12 217/12 R |
| 5,470,521 | A * | 11/1995 | Wenzel | B29B 13/022 264/321 |
| 7,482,924 | B1 | 1/2009 | Beinhocker | |
| 9,421,696 | B2 | 8/2016 | Womack | |
| 2005/0151067 | A1* | 7/2005 | Beinhocker | G08B 13/126 250/227.15 |
| 2008/0053992 | A1* | 3/2008 | DeBord | E04H 1/1205 220/1.6 |
| 2010/0092794 | A1* | 4/2010 | Aylmore | B29C 48/91 428/542.8 |
| 2016/0090234 | A1* | 3/2016 | Ronstadt | B60J 5/08 414/802 |

OTHER PUBLICATIONS

Posted on a website http://FOAMCYCLE.COM by author Louis James Troiano on Oct. 24, 2016.

* cited by examiner

*Primary Examiner* — Monica A Huson
*Assistant Examiner* — Kelsey C Grace
(74) *Attorney, Agent, or Firm* — Marc D. Lowy

(57) ABSTRACT

A mobile polystyrene foam waste recycling method and system are disclosed. The system includes a mobile housing or mobile container that houses a polystyrene foam densifying machine. The foam densifying machine reduces the size of Expanded Polystyrene (EPS) and PS polystyrene material into a marketable product. The mobile container includes secure access doors, electrical connections, lighting, exhaust fans, and storage bins for EPS waste. The waste recycling system provides a mobile outdoor or indoor recycling facility and collection center where EPS/PS may be recycled instead of being sent to a landfill.

13 Claims, 5 Drawing Sheets

METHOD AND SYSTEM FOR RECYCLING POLYSTYRENE WASTE

CROSS REFERENCE TO RELATED APPLICATION(S)

This application claims the benefit of U.S. provisional application No. 62/406,335, filed Oct. 10, 2016, which is incorporated by reference as if fully set forth.

FIELD OF INVENTION

The present invention relates to a method and system for recycling polystyrene foam waste, and more particularly to a recycling environment for polystyrene foam waste.

BACKGROUND

The two basic types of polystyrene suitable for recycling are EPS polystyrene, IE expanded polystyrene, and PS, IE polystyrene. EPS is the expanded type foam used for packaging. PS is the condensed foam commonly used in the food service industry for cups and food clamshells. EPS material is also known as Styrofoam (Dow Chemical Trademarked name) and its recycling symbol is the number 6. EPS foam and PS densifying machines are utilized to reduce the size of EPS/PS Polystyrene material into marketable products.

EPS foam and PS polystyrene densifying machines, regardless of the manufacturers, are normally not constructed for outdoor use and are normally utilized at indoor locations. A typical EPS polystyrene/PS polystyrene densifier machine is not weather resistant by design so an outdoor recycling center operated by a municipality, county, school or college currently has no option to recycle and reduce the size of EPS material.

By encapsulating an EPS/PS densifying machine in a mobile container configured as an EPS polystyrene/PS polystyrene recycling environment, the foam densifying machine may be operated in the vicinity of an indoor or outdoor recycling and collection center, thus enabling the site to collect and recycle EPS polystyrene/PS polystyrene material that would otherwise be sent to a landfill.

Therefore, there is a need for a method and system for efficient indoor or outdoor recycling of EPS polystyrene/PS polystyrene waste. The claimed invention is an improvement over current methods and systems for recycling EPS polystyrene/PS polystyrene waste.

SUMMARY

A method and system for recycling polystyrene waste in either an indoor or outdoor location is disclosed. A polystyrene foam densifying machine is installed and operated within a mobile container that includes multiple walls, a top surface, a bottom surface, and an interior space.

At least one access door is configured in an exterior wall of the mobile container to enable access to the interior space of the mobile container from outside the mobile container. At least one power connection is configured within the mobile container to provide electrical power to the polystyrene foam densifying machine and to other electrical devices as required. At least one exhaust fan and at least one storage container are configured within the mobile container.

In some embodiments of the invention, the mobile container is comprised of a substantially metal container, and other embodiments, the mobile container is comprised of a substantially plastic container or else a substantially wooden container.

In some embodiments of the invention, the mobile container is comprised of an ISO certified intermodal shipping container.

In some embodiments of the invention, the access door is comprised of a roll-up type door, and in other embodiments the access door is comprised of a swinging type door.

In some embodiments of the invention, a locking mechanism is configured on an access door on the exterior of the mobile container. In other embodiments of the invention, at least one electric lighting fixture is configured on exterior or interior surfaces of the mobile container.

Other features and advantages of the present invention will become apparent from the following more detailed description, taken in conjunction with the accompanying drawings, which illustrate, by way of example, the principles of the invention.

BRIEF DESCRIPTION OF THE DRAWING(S)

The foregoing Summary as well as the following detailed description will be readily understood in conjunction with the appended drawings which illustrate embodiments of the invention. In the drawings.

DETAILED DESCRIPTION OF ILLUSTRATIVE EMBODIMENT(S)

The present invention 10 presents a solution to the problem of recycling expanded polystyrene, both EPS and PS polystyrene foam at locations that have no building or structures to house polystyrene foam densifying machines. EPS and PS densifying machines are utilized to reduce the size of EPS/PS polystyrene material into marketable products.

Figure 1:
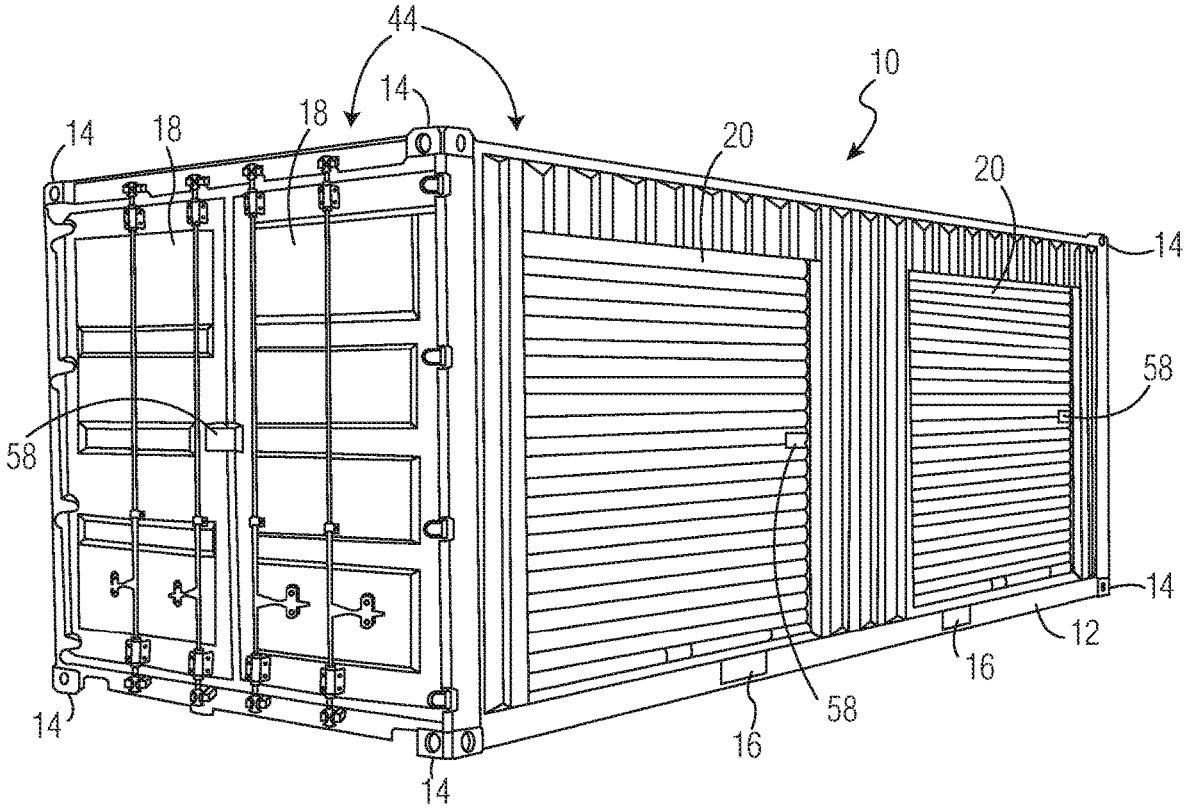
FIG. 1 is a perspective view of a mobile container for a polystyrene recycling system.

FIG. 1 presents a perspective view of the mobile container 12. A polystyrene foam densifying machine 36 (FIG. 4) is installed and operated within a self-contained mobile container 12 that includes multiple side walls 44, top and bottom surfaces 46 (FIG. 2), an interior processing area 24 and an interior storage space 26. The self-contained mobile container 12 can then be operated as a self-contained polystyrene foam recycling system 10. Polystyrene foam can then be processed in either indoor or outdoor locations using the self-contained polystyrene foam recycling system 10.

The mobile container 12 employed in some embodiments of the invention 10 may be a specially designed ISO intermodal certified shipping container built new to the specifications of the invention 10. ISO or intermodal containers 12 comprise containers that meet size, strength, and durability requirements of the invention 10, along with structural integrity suitable for multiple transportation methods such as truck, rail, or ship. The ISO or intermodal shipping container 12 may be prismatic or rectangular in shape, and may be of standardized dimensions or non-standardized dimensions.

At least one access door 18, 20 is configured in an exterior wall 44 of the mobile container 12 to enable access to the interior space 24, 26 of the mobile container 12 from outside the mobile container 12. In some embodiments of the invention 10, modifications to the mobile container 12 may include metal roll-up doors 20 mounted on the sides of the mobile container 12 for user, equipment and material storage access. In other embodiments the access doors 18 are comprised of swinging type hinged doors 18. The roll-up doors 20 or swinging doors 18 are utilized to move into the mobile container 12 unprocessed EPS/PS polystyrene material, and after recycling, remove the condensed EPS/PS pieces known as ingots or blocks.

A display area 22 suitable for signage may be mounted at various clear spanning points on the outside of the mobile container 12.

In some embodiments of the invention 10, the mobile container 12 is comprised of a substantially metal container, and in other embodiments, the mobile container 12 is comprised of a substantially plastic container or else a substantially wooden container.

In some embodiments of the invention 10, the mobile container 12 may have twist lock connectors 14 configured at its ends. The twist lock connectors 14 may be used to lock multiple containers together when shipping as well as to engage the mobile containers 12 for lifting and transport. In some embodiments of the invention 10, the mobile container 12 may be equipped with fork lift tubes 16 configured for lifting and moving the mobile container 12.

In some embodiments of the invention 10, a locking mechanism 58 is configured on an access door 18, 20 on the exterior of the mobile container 12. The locking mechanism 58 prevents unauthorized access to the mobile container 12.

Figure 2:
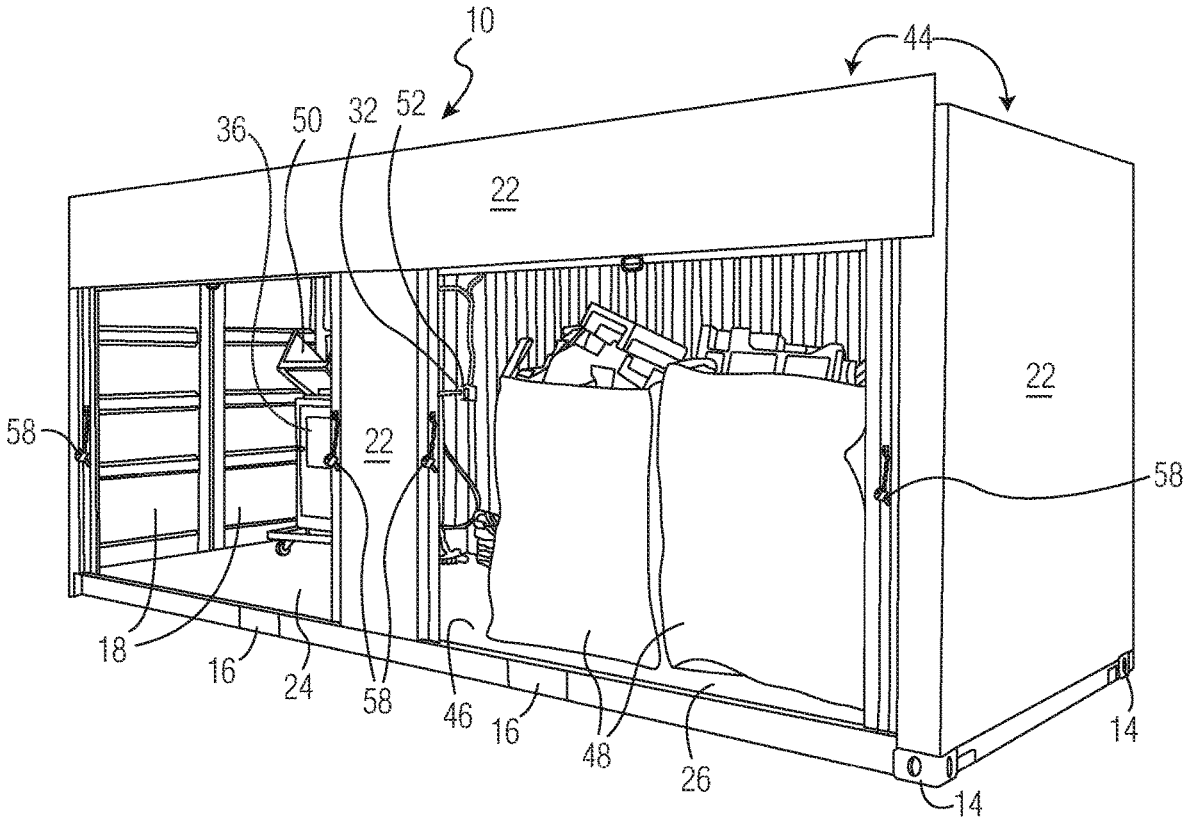
FIG. 2 is a perspective view of a mobile container for a polystyrene recycling system.

FIG. 2 presents a perspective view of a mobile container 12. A polystyrene foam densifying machine 36 is installed and operated within a self-contained mobile container 12 that includes multiple side walls 44, top and bottom surfaces 46, an interior processing area 24 and an interior storage space 26. The self-contained mobile container 12 can then be operated as self-contained polystyrene foam recycling system 10. Polystyrene foam can then be processed in either indoor or outdoor locations using the self-contained polystyrene foam recycling system 10.

A processing area 24 is allocated within the mobile container 12 near the foam densifier 36. A storage area 26 is allocated within the interior of the mobile container 12 that houses plastic carts, plastic containers, or other suitable storage containers 48 used to hold both processed and unprocessed EPS/PS foam.

A display area 22 suitable for signage may be mounted at various clear spanning points on the outside of the mobile container 12.

In some embodiments of the invention 10, the mobile shipping container may have twist lock connectors 14 configured at its ends. The twist lock connectors 14 may be used to lock multiple containers together when shipping as well as to engage the mobile containers 12 for lifting and transport. In some embodiments of the invention 10, the mobile container 12 may be equipped with fork lift tubes 16 configured for lifting and moving the mobile container 12.

The EPS/PS foam densifier machine 36 receives the EPS/PS polystyrene material that is usually placed in a hopper 50. The polystyrene material is ground up, shredded and either heated or cold compressed by the densifier machine 36.

In some embodiments of the invention 10, a locking mechanism 58 is configured on an access door 18, 20 on the exterior of the mobile container 12. The locking mechanism 58 prevents unauthorized access to the mobile container 12.

Figure 3:
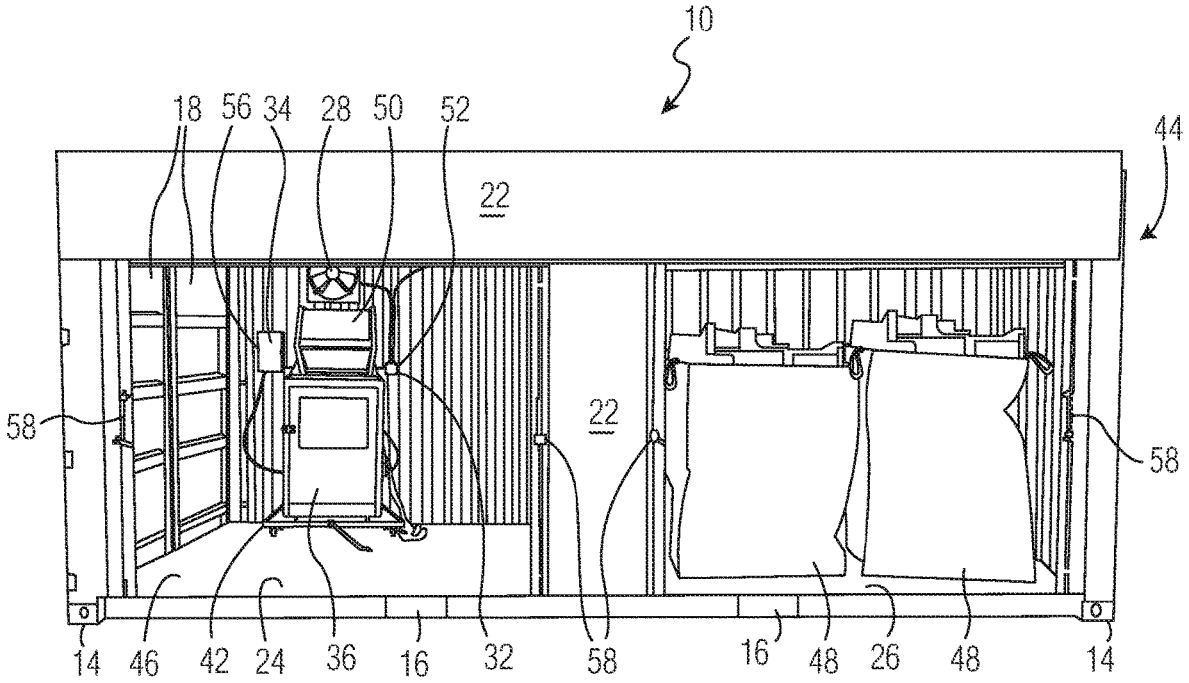
FIG. 3 is a front view of the interior of a mobile container for a polystyrene recycling system.

FIG. 3 presents a front view of the interior of the mobile container 12. FIG. 2 presents a perspective view of a mobile container 12. A polystyrene foam densifying machine 36 is installed and operated within a self-contained mobile container 12 that includes multiple side walls 44, top and bottom surfaces 46 (FIG. 2), an interior processing area 24 and an interior storage space 26. The mobile container 12 can then be operated as self-contained polystyrene foam recycling system 10. Polystyrene foam can then be processed in either indoor or outdoor locations using the self-contained polystyrene foam recycling system 10.

A processing area 24 is allocated within the mobile container 12 near the foam densifier 35. This processing area 24 is in close proximity to the electrical panel 34, power switch 32, exhaust fan 28 and interior lighting 30.

A storage area 26 is allocated within the interior of the mobile container 12 that houses plastic carts, plastic containers, or other suitable storage containers 48 used to hold both processed and unprocessed EPS/PS foam.

In some embodiments of the invention 10, densifier machines 36 are placed on custom-made metal dollies 42 so they can be moved within the processing area 24 for cleaning and maintenance to all points of the densifier machine 36.

A display area 22 suitable for signage may be mounted at various clear spanning points on the outside of the mobile container 12.

An electrical panel 34 will be installed in the mobile container 12 to provide electrical connections to the polystyrene densifier 36, the interior lighting 30, and the exhaust fan 28. The mobile container 12 is equipped with an interior electrical outlet 32 to allow the operation of cleaning equipment such as vacuums and blowers used to keep the mobile container 12 clean when needed.

In some embodiments of the invention 10, the mobile shipping container may have twist lock connectors 14 configured at its ends. The twist lock connectors 14 may be used to lock multiple containers together when shipping as well as to engage the mobile containers 12 for lifting and transport. In some embodiments of the invention 10, the mobile container 12 may be equipped with fork lift tubes 16 configured for lifting and moving the mobile container 12.

The EPS/PS foam densifier machine 36 receives the EPS/PS polystyrene material that is usually placed in a hopper 50. The polystyrene material is ground up by the densifier machine 36.

In some embodiments of the invention 10, a locking mechanism 58 is configured on an access door 18, 20 on the exterior of the mobile container 12. The locking mechanism 58 prevents unauthorized access to the mobile container 12.

Figure 4:
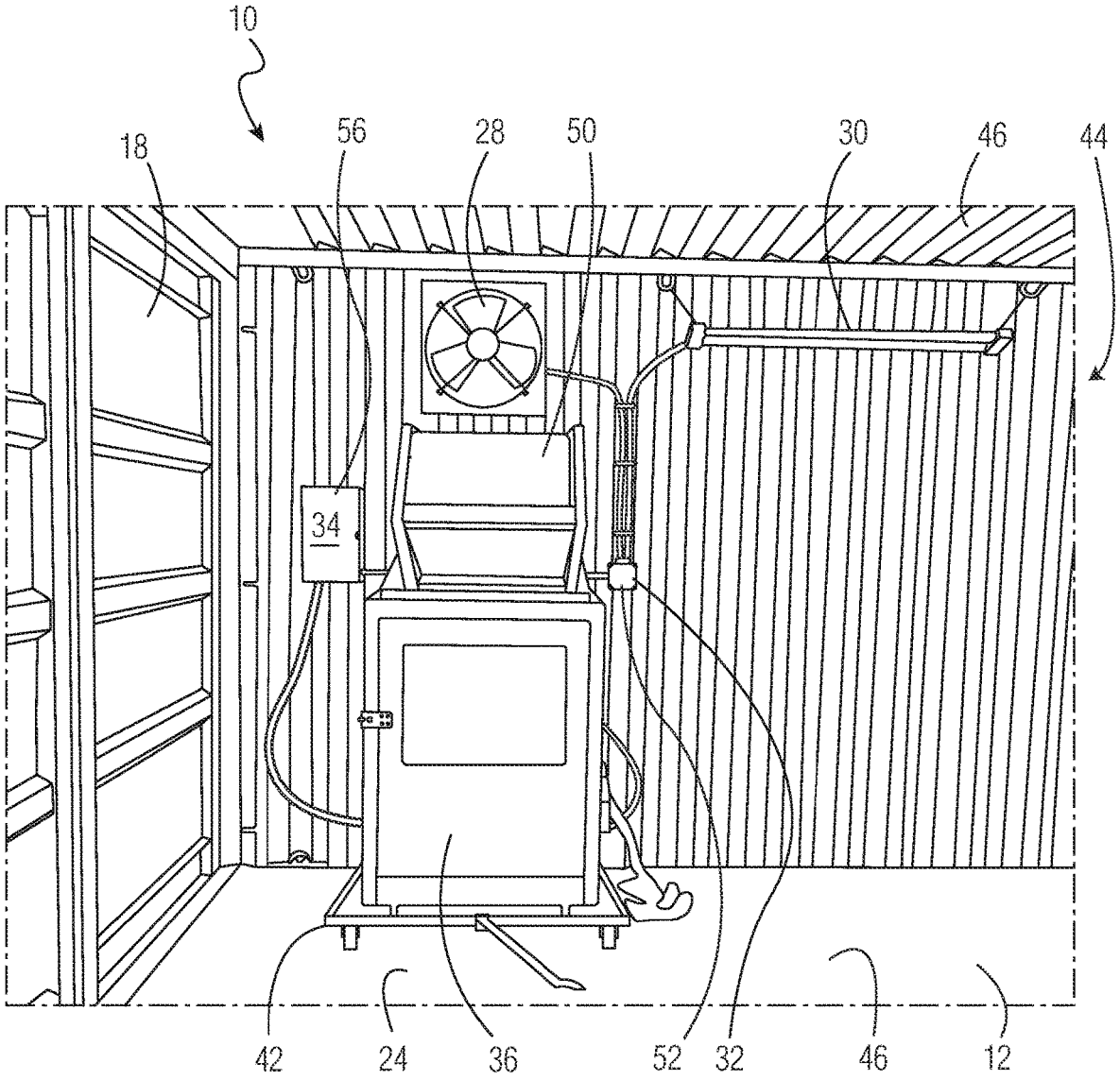
FIG. 4 is a front detail view of a foam densifier machine in the interior of a polystyrene recycling system.

FIG. 4 presents a front detail view of a foam densifier machine 36 installed in the mobile container 12. In some embodiments of the invention 10, the mobile container 12 is equipped with wiring for the operation of optional interior lighting 30 exhaust fans 28. One or more exhaust fans 28 are installed in the side of the mobile container 12 and are used to exhaust interior heat and odor generated by the densifier machine 36.

The EPS/PS foam densifier machine 36 receives the EPS/PS polystyrene material that is usually placed in a hopper 50. The polystyrene material is ground up by the densifier machine 36.

A polystyrene foam densifying machine 36 is installed and operated within a self-contained mobile container 12 that includes multiple side walls 44, top and bottom surfaces 46 (FIG. 2), an interior area 24 and an interior storage space 26.

An electrical panel 34 will be installed in the mobile container 12 to provide electrical connections to the polystyrene densifier 36, the interior lighting 30, and the exhaust fan 28. The mobile container 12 is equipped with a switch 52 controlled interior electrical outlet 32 to allow the operation of cleaning equipment such as vacuums and blowers used to keep the mobile container 12 clean when needed. The mobile container 12 is equipped with a 3 phase power disconnect switch 56 that is permanently mounted to a wall of the mobile container 12 interior wall 44. Thus electrical power that feeds all interior electrical devices such as the densifier unit 36, exhaust fan 28 and interior lights 30 can all be immediately turned on or off.

Interior lighting 30 is mounted on the wall or ceiling of the mobile container 12 so the densifier machine 36 can be operated and polystyrene recycling may be done without the necessity to open the doors 18, 20 of the mobile container 12 to provide outside light.

A commercially available EPS/PS densifying machine 36 is installed in the mobile container 12. The EPS/PS foam densifier machine 36 receives the EPS/PS polystyrene material that is usually placed in a hopper 50. The polystyrene material is ground up by the densifier machine 36. The ground up polystyrene material is heated inside the densifier machine 36 and this more condensed material is extruded at the bottom of the densifier machine 36 into something called an ingot. This ingot is a marketable and saleable commodity which can be sold to the reuse market such as picture frame manufacturers who use this material as a feedstock in making new picture frames.

In some embodiments of the invention 10, densifier machines 36 are placed on custom-made metal dollies 42 so they can be moved within the processing area 24 for cleaning and maintenance to all points of the densifier machine 36.

Figure 5:
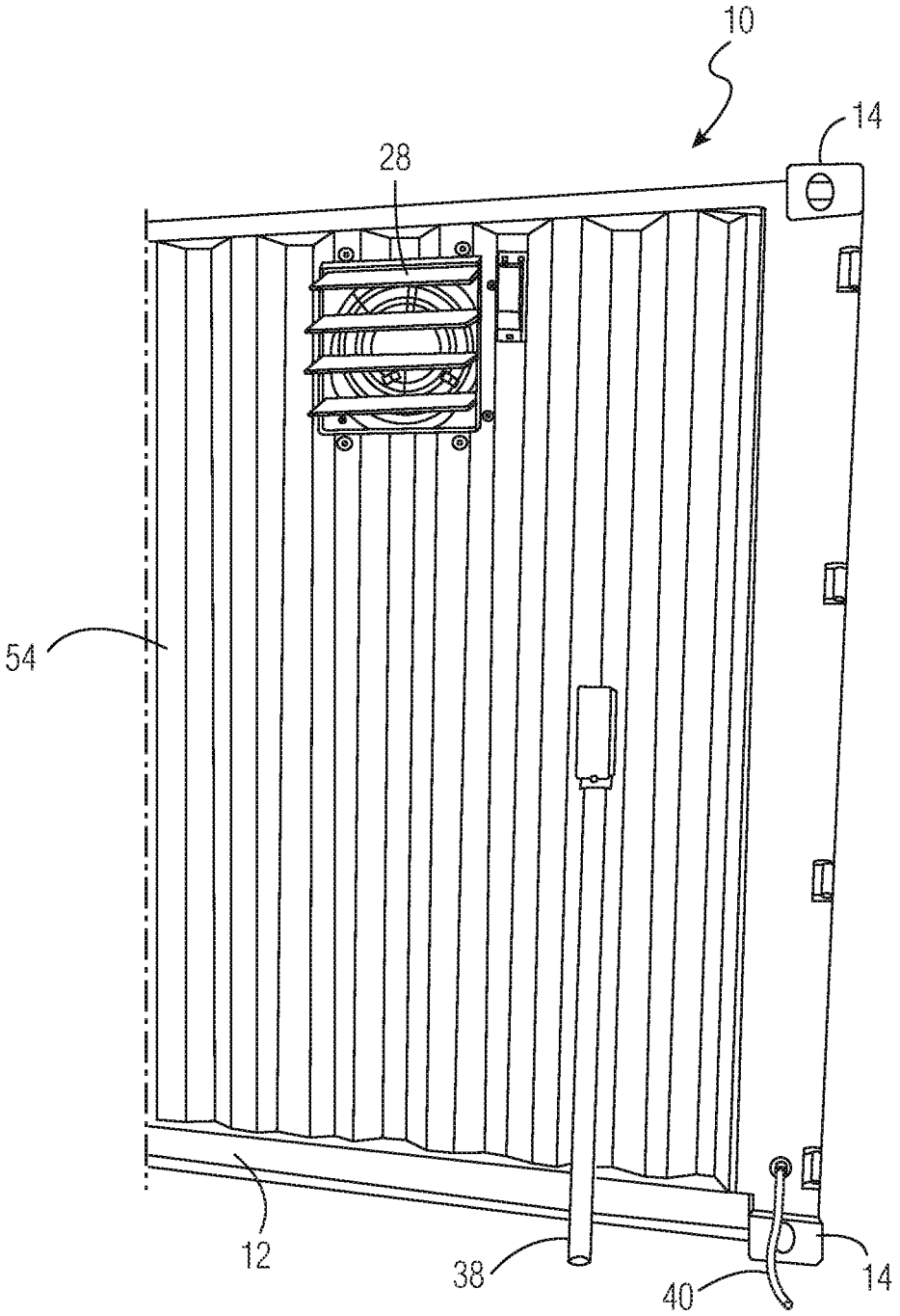
FIG. 5 is a back view of a mobile container for a polystyrene recycling system.

FIG. 5 presents a view of the back 54 of the mobile container 12. The exterior of the exhaust fan 28 is visible. An external electric feed 38 is located outside the mobile container 12 where electric feed wire from an outside source such as a generator or nearby building power enters the mobile container 12 and is connected to the interior electrical panel 34 (FIG. 4). An outside ground wire 40 is used to ensure that the electrical supply to the mobile container 12 meets electrical codes.

In some embodiments of the invention 10, the mobile container 12 may have twist lock connectors 14 configured at its ends.

The entire mobile container 12 including the densifier machine 36 and interior storage containers 48 can be shipped in their entirety by truck, rail and sea. EPS/PS foam densifier machines are not normally manufactured or configured for outdoor use as these machines have many sensitive electrical components. The benefit of this invention 10 is to provide a self-contained EPS/PS polystyrene recycling system at outdoor locations such as county and municipal recycling centers or at buildings that have limited or no interior EPS/PS densifier machine placement capabilities. The invention 10 enables EPS/PS polystyrene recycling at locations that otherwise would not be able to collect and recycle these materials.

While embodiments of the invention 10 have been described in detail above, the invention 10 is not limited to the specific embodiments described above, which should be considered as merely exemplary illustrations set forth for a clear understanding of the principles of the invention 10. Further variations, modifications, extensions, or equivalents of the invention 10 may be developed without departing from the scope of the invention 10. It is therefore intended that the invention 10 not be limited to the particular embodiments disclosed as the best mode contemplated for carrying out this invention 10, but that the invention 10 will include all the embodiments falling within the scope of the appended claims.

What is claimed is:

1. A system for recycling expanded polystyrene foam waste, comprising:

a non-motorized, non-collapsible, transportable container having a plurality of walls, a top surface, a bottom surface, a user accessible floor surface, and a usable interior space;

said usable interior space extending the full interior vertical dimension and full interior horizontal dimensions of said transportable container;

said interior space configured with at least one foam processing area and at least one foam storage area;

an extrusion type expanded polystyrene foam densifier apparatus installed on said user accessible floor surface;

said foam densifier apparatus configured to densify non-hazardous type expanded polystyrene waste;

a non-heated hopper, said hopper having an unobstructed opening configured to receive expanded polystyrene waste;

at least one access door configured in a longitudinal wall of said transportable container, with a lower edge of said access door reaching said floor surface of said transportable container, to enable access to said interior space from outside said transportable container;

at least one electric power connection configured within said transportable container to provide electrical power to said system;

at least one exhaust fan; and at least one storage container configured within said transportable container;

wherein said system comprises a self-contained expanded polystyrene foam waste recycling facility.

2. The system of claim 1, wherein said transportable container comprises a substantially metal container.

3. The system of claim 1, wherein said transportable container comprises a substantially plastic container.

4. The system of claim 1, wherein said transportable container comprises a substantially wooden container.

5. The system of claim 1, wherein said transportable container comprises an intermodal shipping container of standard dimensions.

6. The system of claim 1, wherein said transportable container comprises an intermodal shipping container of non-standard dimensions.

7. The system of claim 1, wherein said access door comprises a roll-up type door.

8. The system of claim 1, wherein said access door comprises a swinging type door.

9. The system of claim 1, further comprising a locking mechanism configured on said access door.

10. The system of claim 1, further comprising at least one electric lighting fixture configured on a surface of said transportable container.

11. The system of claim 1, further comprising at least one display area configured on an outside surface of said transportable container.

12. The system of claim 1, further comprising a plurality of twist-lock connectors configured on said transportable container.

13. The system of claim 1, further comprising a plurality of fork lift tubes configured on said transportable container.

* * * * *